United States Patent [19]

Goott

[11] 3,998,462

[45] Dec. 21, 1976

[54] POKER TYPE GAME APPARATUS

[76] Inventor: Joseph Goott, P.O. Box 1363, Great Falls, Mont. 49403

[22] Filed: May 14, 1975

[21] Appl. No.: 577,544

[52] U.S. Cl. ..... 273/130 H
[51] Int. Cl.[2] ..... A63F 3/00
[58] Field of Search ..... 273/130 H, 136 R, 136 Z, 273/148, 152.31, 135 R

[56] References Cited

UNITED STATES PATENTS

| | | | |
|---|---|---|---|
| 1,407,223 | 2/1922 | Rose | 273/130 H |
| 1,532,722 | 4/1925 | Wall | 273/135 R |
| 3,011,789 | 12/1961 | Eliassen et al. | 273/136 R |
| 3,633,915 | 1/1972 | Lippert | 273/148 R |

FOREIGN PATENTS OR APPLICATIONS

| | | | |
|---|---|---|---|
| 949,733 | 2/1964 | United Kingdom | 273/130 H |

OTHER PUBLICATIONS

*Scarne's Encyclopedia of Games,* John Scarne, Harper & Row, New York, 1973; pp. 278-279, 290-294, 297-298, 302-306.

*Primary Examiner*—Paul E. Shapiro
*Assistant Examiner*—Harry G. Strappello
*Attorney, Agent, or Firm*—Craig & Antonelli

[57] ABSTRACT

A card game apparatus including a playing surface having thereon a plurality of defined areas in the form of rectangles or the like. A dealer using a conventional deck of playing cards places five cards at designated positions on the playing surface. Each player can attempt to guess if one or more of the cards has a value of "9" or better with Aces being high or a value of "2" through "7". Each player can also place chips in defined areas to guess if the hand contains conventional poker hands such as a straight, a flush, and a full house. After each player has completed the process of putting chips in the desired defined areas, the dealer turns each of the five cards over to determine which, if any, players have guessed correctly.

14 Claims, 1 Drawing Figure

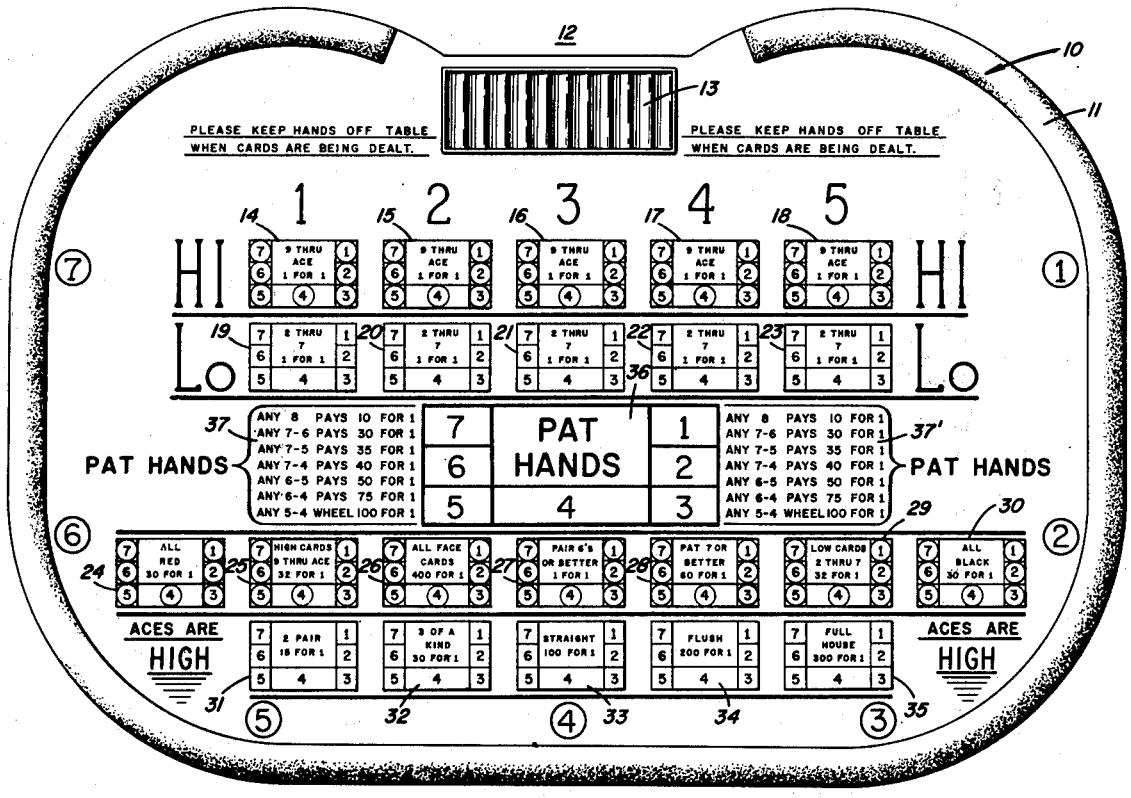

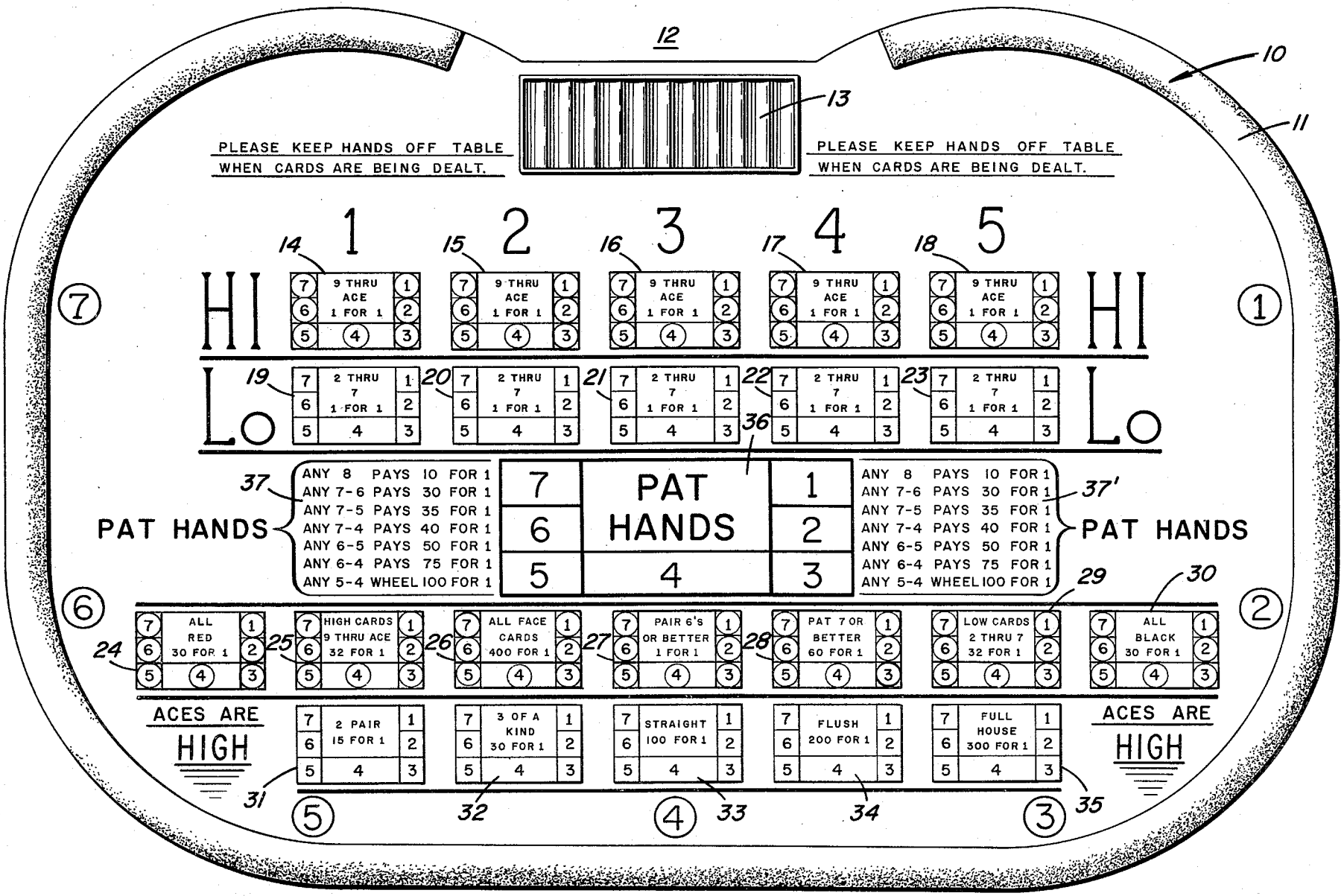
PLEASE KEEP HANDS OFF TABLE
WHEN CARDS ARE BEING DEALT.
HI
LO
9 THRU ACE 1 FOR 1
2 THRU 7 1 FOR 1
PAT HANDS
ANY 8 PAYS 10 FOR 1
ANY 7-6 PAYS 30 FOR 1
ANY 7-5 PAYS 35 FOR 1
ANY 7-4 PAYS 40 FOR 1
ANY 6-5 PAYS 50 FOR 1
ANY 6-4 PAYS 75 FOR 1
ANY 5-4 WHEEL 100 FOR 1
ALL RED 30 FOR 1
HIGH CARDS 9 THRU ACE 32 FOR 1
ALL FACE CARDS 400 FOR 1
PAIR 6'S OR BETTER 1 FOR 1
PAT 7 OR BETTER 60 FOR 1
LOW CARDS 2 THRU 7 32 FOR 1
ALL BLACK 30 FOR 1
2 PAIR 15 FOR 1
3 OF A KIND 30 FOR 1
STRAIGHT 100 FOR 1
FLUSH 200 FOR 1
FULL HOUSE 300 FOR 1
ACES ARE HIGH

POKER TYPE GAME APPARATUS

BACKGROUND AND SUMMARY OF THE PRESENT INVENTION

The present invention relates to a game played basically upon probabilities and, more particularly, a game of chance which utilizes the elements of poker and which can be played by one or more players at the same time.

The game of the present invention is intended to be played by persons having detailed knowledge of poker but, at the same time, is enjoyable and readily understood by those who are only vaguely or not at all familiar with the game of poker and its variants. This is so because the participants in the game are able to play intelligently because the odds are printed upon the game table surface. Moreover, players can make even inconsistent plays on the table, if they so desire, by virtue of the arrangement of the game table surface and the method by which "POKER-ALL" is played.

The foregoing objects have been achieved in accordance with the present invention by providing a game surface upon which a dealer places a number of cards face down from a deck of cards at specific spots. As each card is placed down at the specified spot, each participant in the game can play a number of chips in guessing whether each card is a high card (e.g. 9, 10, Jack, Queen, King, Ace) or a low card (E.G. 2, 3, 4, 5, 6, or 7). If, for example, five cards from a deck of cards are the total number of cards to be placed at specified spots on the game table surface, each participant will have the opportunity of guessing whether one or more of the five cards is a high card or a low card. Of course, the participants are not required to play chips for this purpose, although it is expected that each participant will play in some aspect of the game during each hand that is dealt by the dealer.

After the total number of cards (e.g. 5 cards) have been placed at designated spots on the surface, each game participant will have the opportunity of deciding, for example, if all of the cards in the hand are all red or all black or if all the cards in the hand are face cards (i.e. Jacks, Queens and Kings). Furthermore, the participants have the option of guessing, based upon odds printed on the table surface, whether the dealt hand will contain all high cards (e.g. 9, 10, Jack, Queen, King, Ace), a pair of 6's or better, a pat 7 or better (i.e. 7 or lower with no pairings), all low cards (e.g. 2, 3, 4, 5, 6, or 7), two pairs, three of a kind, a straight, a flush and/or a full house.

The participants can also place their chips on a section of the table for playing "pat hands" wherein the players are informed of the dealer's odds against the chances of the players' being successful. According to a preferred embodiment of the present invention, the highest card in such a pat hand can be an "8" card and the remaining cards must be lower and unpaired. As will be seen in more detail hereinbelow, a "wheel", i.e. a straight of 5, 4, 3, 2, 1, is considered by the dealer to deserve the highest odds in playing "pat hands".

BRIEF DESCRIPTION OF THE DRAWING

These and other objects and advantages of the present invention will become more apparent from the following description when taken in conjunction with the accompanying sole figure, which shows for purposes of illustration only, a plan view of a preferred embodiment of the "POKER-ALL" game surface.

DETAILED DESCRIPTION OF A PREFERRED EMBODIMENT

Referring now to the sole figure, numeral 10 designates generally a game surface which, for purposes of illustration, can be described as being approximately 8 feet in length and about 5½ feet in width and mounted or otherwise arranged on a table of conventional construction. The periphery of the game surface can be provided with a cushioned armrest 11 for the comfort of the players. If the "POKER-ALL" game is made in smaller sizes, however, it is understood that the armrest is optional and can be dispensed with, especially where players can sit around the game surface in comfortable chairs. At a point designated generally by the numeral 12 along one side of the table, an area is provided for a dealer of the cards who also maintains a chip tray 13 wherefrom chips are either given to the players upon winning or received from them if they do not accurately predict the card hand. Around the periphery of the tabletop are the numbers 1, 2, 3, 4, 5, 6 and 7 in circles to designate where each of the players are to position themselves. It is to be clearly understood, however, that seven players are not needed and even one player can play at each deal of a hand. Furthermore, more than seven players can play. The tabletop is not limited to any particular size and can be made, in fact, in varying sizes, depending upon its intended use and the intended market.

The game surface is provided with markings and printed matter for playing the game. This may also include such advisory material as "Please Keep Hands Off Table When Cards Are Being Dealt" on both sides of the chip tray 13 so as to be visible to the players located around the table. Just inwardly of the chip tray 13 toward the center of the table are five large numbers "1" through "5" to designate where each of the five cards dealt in a particular hand are to be placed face down during the game. On one side of approximately the center line of the table are provided two rows of boxes with a box in each row aligned under each large number. One row of five boxes (designated for description purposes here only by the numerals 14 through 18) is designated by the word "HI". Similarly, the other row of five boxes aligned with each large number and with the "HI" boxes is designated by the word "Lo" (designated for description purposes here only by the numerals 19 through 23). Each such box in both rows is subdivided into smaller boxes constituting a numbered space corresponding to the number of the player at his place at the periphery of the surface whereby each of the players 1 through 7 can place his chip or chips in the appropriate numbered space 1 through 7. The manner in which the players proceed to utilize these boxes and the sequence will be described in greater detail hereinbelow. However, it can be seen that the players have a choice for each card being dealt of calculating the chance of whether such card is a high card (i.e. 9, 10, Jack, Queen, King or Ace), or a low card (i.e. 2, 3, 4, 5, 6, or 7). In any event, the odds given by the dealer are also stated in both the "HI" and "Lo" boxes as being one-for-one. That is, a player who correctly guesses whether the card is high or low will receive a chip for every chip that he puts in his appropriate space in either boxes 14 through 18 and/or boxes 19 through 23.

On the other side of the center line of the table surface are provided a row of boxes (designed for purposes of description here only by the numerals 24 through 30) where the players can also calculate the chances of the cards 1 through 5 dealt in a hand being all red, and/or high card (9 through Ace), and/or all face cards (Jacks, Queens, Kings), a pair of sixes or better, a pat 7 or better (no card higher than a seven and no pairings), and/or low cards (2 through 7), and/or all black. Again the odds that the dealer will give on the correctness of any such guess are stated in each of the appropriate boxes and vary according to the mathematical probability of achieving such a hand. Likewise, there is also provided a row of boxes (designated for purposes of description here only by the numerals 31 through 35) with a space therein for each player to place one or more chips if he calculates that in the card hand dealt there will be either two pair, three of a kind, a straight, a flush or a full house, which terms are well known in the game of poker and which are used here in the same sense. Again, the odds that the dealer will give for successfully guessing the occurrence of such an event are stated in each of the boxes. In the embodiment shown, for these two series of boxes 24 through 30 and 31 through 35, the players are clearly advised on the table that "Aces Are Hi".

In approximately the center of the table is a box 36 larger than the above described row of boxes and within which is the printing "PAT HANDS". In such box there are subdivided areas for each of the players to put one or more chips corresponding to his number on the table surface. On both sides of this box are printed in large letters and numbers the instructions and odds 37, 37' for the "pat hands." For example, for pat hands an Ace can be considered a "1". If the cards dealt in a hand when turned over at game's end by the dealer comprise a 5, 4, 3, 2 and an Ace (also known as a "wheel"), the players who play for a "pat hand" are entitled to receive a hundred chips for every chip played.

The manner in which the game is played will now be described. A dealer stands at his station 12 with the chip tray 13, and each of the players take a position around the periphery of the table at the spots numbered 1 through 7. The dealer is always in charge of shuffling the cards and placing five cards on the numbers 1 through 5 just beyond his chip tray 13. The play can proceed clockwise starting with player 1 and then through the remaining players 2, 3, etc. The dealer first puts a card down on the spot designated by the large number "1". The card is face down and player 1 can either calculate that the card will be a 9 through an Ace and put a chip or chips at spot 1 in box 14 or is a low card (2 through 7) and place a chip or chips in spot 1 in box 19. Each player in turn can do likewise. The dealer and the players then repeat this process with respect to spots designated by the large numerals "2", "3", "4" and "5" and the boxes aligned thereunder.

Before the cards are turned face up one at a time, each of the participants can play the row of boxes 24 through 30 and 31 through 35 with the appropriate odds for succeeding indicated in each box played. Furthermore, the players, if they desire, can put a chip or chips in all of the boxes at the appropriate spots. If, for example, player 3 wishes to place a chip in box 28 believing that the hand will be a pat 7 or better, he will place his chip or chips in the subdivided area designated by the numeral 3 in a circle in box 28. After all the cards have been dealt and all the chips have been placed, the cards are turned over by the dealer sequentially. If the highest card in the hand is a seven with no pairings, then player 3 will receive sixty chips for each chip that he played.

The players can also elect to play in box 36 denominated as "PAT HANDS". The rules and odds for this play are designated on each side of the table in the areas 37, 37'. If, for example, after the cards are dealt player number 5 wishes to place a chip or chips in the "PAT HANDS" box 36, he will place the chips in the subdivided area designated by the numeral 5 in box 36. If, when the dealer turns over all of the cards, the highest card in the hand is "8" and there are no pairs (Aces can be considered low here), then player number 5 receives ten chips for every chip that he played. Similarly, if the hand consist of a "7–6" combination as the high cards with no pairs, then player number 5 receives thirty chips for each chip that he played. To complete the description of the "PAT HANDS" box 36, it is also stated that if a hand contains as the high cards a "7–5" combination with no pairs, then player number 5 will receive 35 chips for every one, whereas a "7–4" high combination with no pairs will entitle player number 5 to receive forty chips for every chip played. The highest odds are given for a "wheel" which is a straight consisting of 5, 4, 3, 2, and Ace for which player number 5 would receive one hundred chips for every chip played. As each card on the larger numerals 1 through 5 is turned face up, the players who have played the corresponding "HI" and "Lo" boxes will find out if they have won and can then be given the appropriate equal number of chips depending upon the number of chips played.

To make the rows of boxes readily apparent and readily visible for quick play, it may be desirable to alternate the color of the rows of boxes. By way of illustration it may be desirable to make the "HI" row of boxes 14 through 18, the "PAT HANDS" box 37 and the row of boxes 31 through 35 yellow while making the "Lo" row of boxes 19 through 23 and the other row 24 through 30 red. Obviously, other colors which achieve this result can also be used.

While I have shown and described an embodiment in accordance with my invention, it is to be clearly understood that the same is susceptible of changes and modifications as will be apparent to one of ordinary skill in this art. For example, the game surface can be constructed of smaller size so as to be portable or for parlor use. Accordingly, I do not wish to be limited to the details shown and described herein but intend to cover all such changes and modifications as are encompassed by the scope of the appended claims and within the intendment of the present invention.

I claim:

1. A game apparatus used in combination with a conventional deck of playing cards as are used in the game of poker as well as chips and in which one or more persons can participate as players and one person is to act as a dealer, comprising:

a playing surface;

means associated with said surface for designating a plurality of positions at which a specific number of cards from the deck constituting a hand are to be placed;

a portion of the surface adjacent the periphery thereof having thereon consecutively numbered spots at spaced locations where each player is to be stationed during a game;

means associated with the playing surface for designating a first series of defined areas arranged in a row aligned with and corresponding to each card in the hand, each defined area including consecutively numbered portions corresponding to the numbered spots so that each player can guess whether one or more cards in the hand has a value of "9", "10", Jack, Queen, King, or Ace by placing one or more of the chips in the respective numbered portion of one or more defined areas in the first series:

means associated with the playing surface for designating a second series of defined areas arranged in a row aligned with a respective designating means and corresponding to each card in the hand, each defined area including consecutively numbered portions corresponding to the numbered spots so that each player can guess whether one or more cards in the hand has a value of "2", "3", "4", "5", "6", or "7" by placing one or more of the chips in the respective numbered portions of one or more defined areas in the second series;

means associated with the playing surface for designating a third series of defined areas which include consecutively numbered portions corresponding to the numbered spots so that each player can guess whether the hand consists of all red cards, all high cards, all low cards, all black cards, all face cards, a pair of "6"s or better, and a pat "7" or better by placing one or more chips in the respective numbered portion of one or more defined areas in the third series; and means associated with the playing surface for designating a fourth series of defined areas which include consecutively numbered portions corresponding to the numbered spots so that each player can guess whether the hand consists of two pairs, three of a kind, a straight, or a full house by placing one or more of the chips in the respective numbered portion of one or more defined area in the fourth series.

2. A game apparatus as set forth in claim 1, further including means associated with the playing surface for designating a defined area containing consecutively numbered portions corresponding to the numbered spots so that each player can guess whether the card of highest value in the hand is no higher than "8" with the hand containing no pairs by placing one or more of the chips in the respective numbered portion.

3. A game apparatus as set forth in claim 2, further including a place at the periphery of the surface from which the dealer can place and subsequently turn over the individual cards of the hand at the designated positions.

4. A game apparatus as set forth in claim 3, wherein the first series of defined areas is designated as the "HI" row and the second series of defined areas is designated as the "Lo" row.

5. A game apparatus as set forth in claim 4, wherein five designated positions are provided and are marked consecutively as "1", "2", "3", "4", and "5".

6. A game apparatus as set forth in claim 5, wherein each defined area has associated therewith the odds against which each player is guessing for a particular combination in a hand and for a particular value of one or more cards in the hand.

7. A game apparatus as set forth in claim 6, including a cushion provided at a substantial portion of the periphery of the playing surface.

8. A game apparatus as shown in the accompanying drawing.

9. A game apparatus in combination with a conventional deck of playing cards as are used in the game of poker as well as chips and in which one or more persons can participate as players and one person is to act as a dealer, comprising:

a playing surface;

first means located on said surface designating a plurality of positions at which a specific number of cards from the deck constituting a hand are to be placed;

second means located on the playing surface designating a first series of defined areas corresponding to said plurality of positions, each of the defined areas including a plurality of indicia means for receiving chips so that each player can guess whether one or more cards in the hand has a value of "9", "10", Jack, Queen, King, or Ace by placing one or more chips on a respective indicia means of one or more defined areas in the first series;

third means located on the playing surface for designating a second series of defined areas corresponding to said plurality of positions, each of the defined areas including a plurality of indicia means for receiving chips so that each player can guess whether one or more cards in the hand has a value of "2", "3", "4", "5 ", "6", or "7" by placing one or more of the chips on a respective indicia means of one or more defined areas in the second series:

fourth means located on the playing surface designating a third series of defined areas, each of the defined areas including a plurality of indicia means for receiving chips so that each player can guess whether the hand consists of all red cards, all high cards, all low cards, all black cards, all face cards, a pair of "6's" or better, a pat "7" or better by placing one or more chips on a respective indicia means of one or more defined areas in the third series; and fifth means located on the playing surface designating a fourth series of defined areas, each of the defined areas including a plurality of indicia means for receiving chips so that each player can guess whether the hand consists of two pairs, three of a kind, a straight, or a full house by placing one or more chips on a respective indicia means of one or more defined areas in the fourth series.

10. A game apparatus as set forth in claim 9, further including sixth means located on the playing surface designating a defined area and including a plurality of indicia means for receiving chips so that each player can guess whether the card of highest value in the hand is no higher than "8" with the hand containing no pairs by placing one or more chips on a respective indicia means of the sixth means.

11. A game apparatus as set forth in claim 9, wherein the second means is designated on the playing surface as the "HI" series of defined areas and the third means is designated on the playing surface as the "Lo" series of defined areas.

12. A game apparatus as set forth in claim 9, including a place from which a dealer can place the specific number of cards in the hand at their respective designated positions.

13. A game apparatus as set forth in claim 9, wherein a portion of the playing surface adjacent the periphery thereof has thereon consecutively numbered spots at which each player is to be stationed during a game.

14. A game apparatus as set forth in claim 13, wherein each plurality of indicia means includes consecutive numbers corresponding to the numbered spots and constituting the portion of each defined area upon which the player at each spot is permitted to place one or more chips with the stated possibility of receiving at least an equal number of chips for a correct guess.

* * * * *